US007182417B2

(12) United States Patent
Taylor et al.

(10) Patent No.: US 7,182,417 B2
(45) Date of Patent: Feb. 27, 2007

(54) REFRIGERATION CASE CLIP ASSEMBLY

(75) Inventors: Steven Hilles Taylor, Crestwood, KY (US); Charles William Newton, Lebanon Junction, KY (US)

(73) Assignee: General Electric Company, Schenectady, NY (US)

( * ) Notice: Subject to any disclaimer, the term of this patent is extended or adjusted under 35 U.S.C. 154(b) by 135 days.

(21) Appl. No.: 09/682,857

(22) Filed: Oct. 25, 2001

(65) Prior Publication Data

US 2003/0080662 A1 May 1, 2003

(51) Int. Cl.
*A47B 96/04* (2006.01)

(52) U.S. Cl. ..... 312/406.2

(58) Field of Classification Search ..... 312/400, 312/401, 406, 406.2, 407, 257.1, 116, 296
See application file for complete search history.

(56) References Cited

U.S. PATENT DOCUMENTS 3,380,615 A * 4/1968 Kessler ..... 312/406.2 X
3,489,477 A * 1/1970 Harder, Jr. ..... 312/406.2 X
3,633,783 A * 1/1972 Aue ..... 312/406.2 X
4,134,626 A * 1/1979 Kordes ..... 312/405
4,162,571 A 7/1979 Horvay
4,632,470 A 12/1986 Jenkins et al.
4,822,117 A 4/1989 Boston, Jr.
4,958,890 A * 9/1990 Anderson et al. ..... 312/406.2
4,974,914 A * 12/1990 Jenkins ..... 312/406.2
5,720,536 A 2/1998 Jenkins et al.
5,897,181 A * 4/1999 Avendano et al. ..... 312/401
6,036,293 A * 3/2000 Anell et al. ..... 312/406

FOREIGN PATENT DOCUMENTS

GB 683739 * 12/1952 ..... 312/406.2

* cited by examiner

*Primary Examiner*—James O. Hansen
(74) *Attorney, Agent, or Firm*—Armstrong Teasdale LLP

(57) ABSTRACT

A refrigerator cabinet includes a bottom mullion and a casing. One of said bottom mullion and said casing includes a retaining tongue and the other of said bottom mullion includes an engagement surface for being received in said tongue. A method for fabricating the cabinet includes attaching the bottom mullion to a casing shell by hand, inserting an inner liner into the casing shell, attaching a casing bottom panel to the bottom mullion by hand, and injecting a foam insulation medium between the casing and the inner liner.

14 Claims, 2 Drawing Sheets

REFRIGERATION CASE CLIP ASSEMBLY

BACKGROUND OF INVENTION

This invention relates generally to refrigeration appliances, and, more particularly to, an apparatus and method for constructing refrigeration appliance cabinets.

Known refrigeration appliances, such as refrigerators, include a cabinet housing including an outer case and one or more inner liners therein that defines a fresh food compartment and a freezer compartment. The fresh food compartment and freezer compartments are closed by separate access doors hingedly attached to the case. A mullion extends across the front of a partition that separates the fresh food and freezer compartments in the liner and is attached to the outer case to reinforce the front of the outer case and preserve a pleasing aesthetic appearance of the refrigerator. Typically, the casing is fabricated from relatively thin sheet metal and includes a U-shaped shell to which a back and a bottom panel are attached to form an enclosure that contains the liner. A resin foam insulation medium is interposed between the casing and a plastic liner to insulate the refrigeration compartments of the refrigerator and also to increase structural rigidity and strength of the refrigerator cabinet. See for example, U.S. Pat. Nos. 4,822,117 and 4,632,470. A lower rail extends across the bottom of the cabinet and includes a grille providing access to a machinery compartment in the bottom of the refrigerator compartment.

While for some time refrigerator liners were installed into cabinets that were pre-fabricated with the foam, recent manufacturing efforts have been directed to foaming refrigerator cabinets after the liners have been inserted into the casing shell, a practice which has been found to reduce undesirable liner stress and associated cracking of the liner in use.

However, foaming of the cabinets after insertion of liners has proven problematic in other aspects. For example, once the liner is installed into the casing shell, access is severely restricted to attach the casing bottom panel to the shell, and conventional automated equipment to install the casing bottom panel cannot be used. While tooling and fixtures to install the casing bottom panel to the cabinet before foaming operations may be found, they may be employed only with increased manufacturing and assembly costs. In addition, difficulties in securing the casing bottom panel to the shell tend to result in undesirable foam leaks in foaming operations, especially in an area where the casing bottom panel is attached to the lower rail at the bottom of the refrigerator

SUMMARY OF INVENTION

In one aspect. a refrigeration appliance cabinet is provided that comprises a bottom mullion and a casing. One of said bottom mullion and said casing comprises a retaining tongue and the other of said bottom mullion comprises an engagement surface for being received in said tongue.

In another aspect, a refrigerator cabinet is provided which comprises a bottom mullion, and a casing in press fit engagement with said bottom panel.

In a further aspect, a refrigerator cabinet is provided. The cabinet comprises a casing, an inner liner within said casing and said inner liner comprising at least one refrigeration compartment. A bottom mullion is configured to receive a portion of said inner liner, and said casing is configured to receive a portion of said bottom mullion with press fit engagement.

In still another aspect, a method for fabricating a refrigeration appliance cabinet is provided. The refrigerator cabinet includes a casing shell, an inner liner, a casing bottom panel, and a bottom mullion. The method comprises attaching the bottom mullion to the casing shell by hand, inserting the inner liner into the casing shell, attaching the casing bottom panel to the bottom mullion by hand, and injecting a foam insulation medium between the casing and the inner liner.

In yet another aspect, a method for fabricating a refrigerator cabinet is provided. The cabinet includes a casing shell, an inner liner, a casing bottom panel, and a bottom mullion including opposite side surfaces, each of the side surfaces including a channel. The method comprises inserting the inner liner into the casing shell, press fitting the bottom mullion to the inner liner such that the inner liner is received in one of the bottom mullion channels, press fitting the casing bottom panel to the bottom mullion, and injecting a foam insulation medium between the casing and the inner liner.

In still a further aspect, a method for fabricating a refrigerator cabinet is provided. The cabinet includes a casing shell, an inner liner, a casing bottom panel including a retaining tongue extending therefrom, and a bottom mullion including opposite side surfaces, each of the side surfaces including a channel. The method comprises inserting the inner liner into the casing shell, press fitting the lower rail to the bottom mullion such that the lower rail is received in one of the bottom mullion channels, press fitting the bottom mullion to the inner liner such that the inner liner is received in one of the bottom mullion channels, press fitting the casing bottom panel to the bottom mullion such the retaining tongue engages the bottom mullion, and injecting a foam insulation medium between the casing and the inner liner.

DETAILED DESCRIPTION

Figure 1:
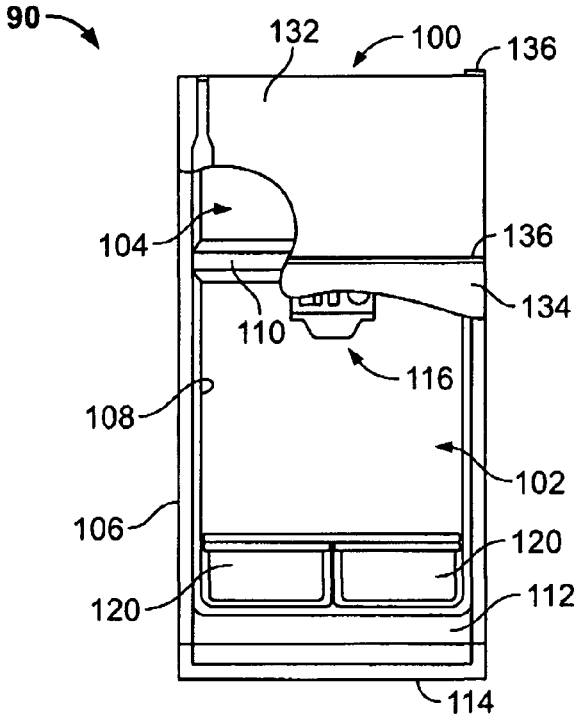
FIG. 1 is front elevational view partly broken away of an exemplary refrigerator according to the present invention.

FIG. 1 is front elevational view partly broken away of an exemplary refrigeration appliance 90 according to the present invention. In an illustrative embodiment, refrigeration appliance 90 is a top-mount refrigerator including a cabinet 100 that supports a fresh food storage compartment 102 and a freezer storage compartment 104 in a vertically oriented position relative to one another. While the exemplary embodiments described and illustrated herein are in reference to a top-mount refrigerator, such as refrigerator 90, it is understood that the principles set forth herein are equally applicable to side-by-side refrigerators having fresh food and freezer compartments extending on opposite sides of a vertical wall. Moreover, the inventive concepts described herein are further applicable to single compartment refrigerators and freezers. As the benefits of the invention accrue generally to refrigeration appliances, the description set forth herein is for illustrative purposes only and is in no way intended to be restricted to a particular type of refrigeration appliance, such as, for example, refrigerator 90.

Refrigerator 90 includes an outer case or casing 106 and an inner liner 108 disposed within casing 106 and defining fresh food compartment 102 and freezer compartment 104. As described in more detail below, a space between case 106 and liner 108 is filled with foamed-in-place insulation. Also, as further described below, outer case 106 normally is formed by folding a sheet of a suitable material, such as pre-painted steel, into an inverted U-shape to form a casing shell having top and side walls. A bottom wall or bottom panel (not shown in FIG. 1) of case 106 normally is formed separately and attached to the case shell side walls and to a bottom frame that includes a front rail 114 to provides support for refrigerator 100 and to facilitate air flow around and beneath cabinet 102 to ventilate a machinery compartment (not shown in FIG. 1) in a bottom rear portion of cabinet 100. Inner liner 108 is molded from a suitable plastic material to form freezer compartment 104 and fresh food compartment 106, respectively. It is understood, however, that in alternative embodiments fresh food compartment 102 and freezer compartment 104 may be defined by separate liners.

In an alternative embodiment, liner 108 may be formed as desired by bending and welding a sheet of a suitable metal, such as steel, to produce relatively large capacity refrigeration units. Furthermore, in such a large capacity unit, separate fresh food and freezer compartment liners are employed for added strength and to facilitate manufacturing tolerances. In smaller refrigerators, such as refrigerator 90, a single liner 108 is formed and an upper mullion strip 110 spans between opposite sides of case 106 and is attached to case 106, thereby covering a dividing partition or mullion wall that divides liner 108 into a freezer compartment 104 and fresh food compartment 102. A lower mullion 112 extends across a bottom portion of case 106, and as will become apparent below, facilitates assembly of cabinet 102. Upper mullion strip 110 and bottom mullion 112 are each formed from a suitable resilient material, such as an extruded acrylo-butadiene-styrene based material (commonly referred to as ABS) in an exemplary embodiment.

Storage shelves (not shown) and slide-out drawers 120 normally are provided in fresh food compartment 102 to support items being stored therein. Additionally, shelves or storage baskets (not shown) may be provided in freezer compartment 104 for food storage therein. Still further, an ice maker (not shown) may be provided in freezer compartment 104.

Temperature regulation and control of fresh food compartment 102 and freezer compartment 104 is accomplished by manipulation of an airflow control mechanism 116 located in fresh food compartment 102. In one embodiment, a microprocessor (not shown) operates airflow dampers (not shown) and fans (not shown) to open, close, or restrict an airflow path between freezer compartment 104 and fresh food compartment 102. Temperature settings are selectable by a user via manipulation of control knobs and dials coupled to the microprocessor. In alternative embodiments, known mechanical control mechanisms are employed in conjunction with mechanism 116 in lieu of electronic controls for selection of refrigerator compartment temperature settings and regulation of airflow in refrigerator 90. Other known features may be further integrated into airflow control mechanism 116, such as lighting fixtures for illumination of fresh food compartment 102.

A freezer door 132 and a fresh food door 134 close access openings to fresh food and freezer compartments 102, 104, respectively. Each door 132, 134 is mounted by a top hinge 136 and a bottom hinge (not shown) to rotate about its outer vertical edge between an open position and a closed position enclosing the associated storage compartment. Freezer door 132 includes a plurality of storage shelves (not shown) and a sealing gasket (not shown), and fresh food door 134 also includes a plurality of storage shelves (not shown) and a sealing gasket (not shown).

In accordance with known refrigerators, the machinery compartment behind front rail 114 at least partially contains components for executing a vapor compression cycle for cooling air. The components include a compressor (not shown), a condenser (not shown), an expansion device (not shown), and an evaporator (not shown) connected in series and charged with a refrigerant. The evaporator is a type of heat exchanger which transfers heat from air passing over the evaporator to a refrigerant flowing through the evaporator, thereby causing the refrigerant to vaporize. The cooled air is used to refrigerate fresh food compartment 102 and freezer compartment 104. As the refrigeration cycle components are beyond the scope of the present invention but well within the purview of those in the art, further discussion thereof is omitted.

Figure 2:
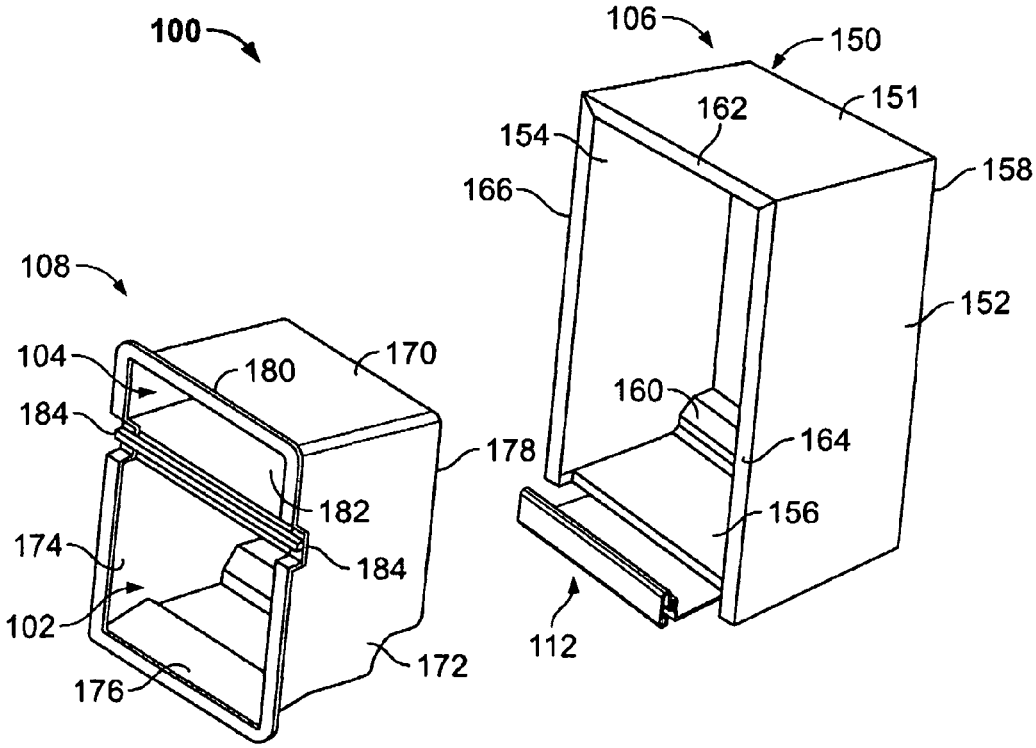
FIG. 2 is a partial exploded perspective view of the refrigerator shown in FIG. 1.

FIG. 2 is a partial exploded perspective view of refrigerator cabinet 100 including outer case 106 and inner liner 108. Outer case 106 includes an inverted U-shaped shell 150 including a top wall 151 and spaced apart opposite side walls 152, 154 extending downwardly from lateral sides of top 151. Shell walls 151, 152, 154 are formed from a single piece of material bent into an open, box like configuration. A separately formed bottom panel 156 is attached to a lower end portion of shell side walls 152, 154, and a separately formed case rear panel 158 is attached to shell side walls 152, 154, shell top wall 151, and case bottom panel 156 to form an open-sided, generally rectangular enclosure for inner liner 108. Bottom panel 156 includes a raised portion 160 at the rear end thereof that forms the machinery compartment to house refrigeration cycle components underneath bottom panel 156.

Case shell 150 includes front faces 162, 164, 166 depending inwardly from forward edges of top wall 151 and side walls 152, 154. Upper mullion strip 110 (shown in FIG. 1) and lower mullion 112 are each attached to case front faces 164, 166 after inner liner 108 is inserted into shell 150. In further embodiments, reinforcing elements, strips and frames may be secured to shell front faces 162, 164, 166 to maintain a proper spacing and orientation of shell walls 151, 152, and 154 and to avoid deflection of cabinet 100 in use.

Inner liner 108 is integrally formed from a plastic material and includes a top wall 170, opposing side walls 172, 174 extending from top wall 170, a bottom wall 176 extending from side walls 172, 174, and a rear wall 178 attached to liner side walls 172, 174, top wall 170, and bottom wall 176 to form an open-sided box-like enclosure. An outwardly projecting flange 180 extends around an open front edge of liner 108 Flange 180 seats against cabinet front faces 162, 164, 166 when liner 102 is inserted into case 106. A dividing wall or mullion 182 is mounted in liner 108 in alignment with indented portions 184 of liner side walls 172, 174, and thus divides liner 108 into fresh food compartment 102 and freezer compartment 104.

Once liner 108 is positioned within case 106, upper mullion strip 110 is secured to case front faces 164, 166, over mullion 182 and bottom mullion 112 is installed. Bottom mullion 112 is secured to shell outer faces 164, 166 and, as set forth more fully below, facilitates attachment of case bottom panel 156 and front rail 114 (shown in FIG. 1) with simple press fit engagement after liner 108 is positioned within case 106. After case rear panel 158 is attached to case shell 150, a known resin foam insulation medium (not shown in FIG. 2) is then interposed between case shell 150 and inner liner 108, between case bottom panel 156 and also between liner rear wall 178 and case rear panel 158. The resin foam insulation medium in one embodiment is a polyurethane composition in liquid/gas form that expands in the space between liner 108 and case 106 and is solidified by curing according to known techniques to a solid foam that adheres to case 106 and liner 108 to form a structurally rigid yet insulated cabinet 100.

Figure 3:
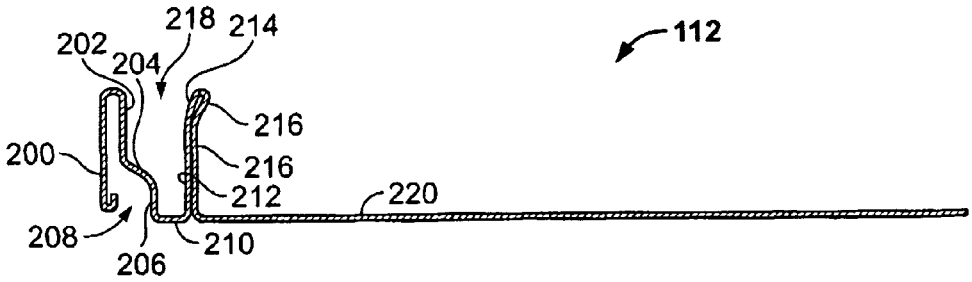
FIG. 3 is a cross sectional view of a bottom mullion for the refrigerator shown in FIGS. 1 and 2.

FIG. 3 is a cross sectional view bottom mullion 112 that facilitates attachment of case bottom panel 156 (shown in FIG. 2) after liner 108 (shown in FIG. 2) has been installed into case 106 (shown in FIG. 2), and also that substantially prevents foam leaks during foaming processes in fabrication of cabinet 100 (shown in FIG. 2).

Bottom mullion 112 includes a front face 200 extending across a bottom portion of cabinet 106 (as shown in FIG. 1), a first retainer portion 202 extending opposite and generally parallel to front face 200, a guide portion 204 extending downwardly and obliquely away from liner retainer portion 202, and a second retainer portion 206 extending downward from guide portion 204 and extending substantially parallel to bottom mullion front face 200 and first retainer portion 202. Collectively, first retainer portion 202, guide portion 204 and second retainer portion 206 form a front rail channel 208 for receiving front rail 114 (shown in FIG. 1) with press fit engagement. Guide portion 204 facilitates hand insertion of front rail 114 without tools by guiding front rail 114 into a proper position as front rail 114 is inserted into front rail channel, thereby eliminating precise relative positioning of front rail 114 and bottom mullion 112 that may otherwise require fixtures or time consuming manual dexterity and assembly.

Bottom mullion 112 further includes a substantially flat liner base portion 210 extending from and substantially perpendicular to second retainer portion 206. A third retainer portion 212 extends upwardly from and substantially perpendicular to liner base portion 210 and includes an upwardly and outwardly extending flare portion 214 at an upper end thereof that extends away from guide portion 204. Bottom mullion 112 is folded back upon itself to form a reinforcing section 216 adjacent flare portion 214 and third retainer portion 212. Collectively, first retainer portion 202, guide portion 204, second retainer portion 206, liner base portion 210, and third retainer portion 212 form a liner channel 218 that receives liner 108 (shown in FIGS. 1 and 2) with press-fit engagement. Guide portion 204 facilitates hand installation of bottom mullion 112 to liner 108 without tools by guiding liner flange 180 (shown in FIG. 2) into a proper position as liner flange 180 is received into liner channel 218, thereby eliminating precise relative positioning of bottom mullion 112 relative to liner 108 that may otherwise require fixtures or time consuming manual dexterity and assembly.

In addition, liner channel 218 and front rail channel 208 extend from opposite sides of bottom mullion 112 such that one of them may be accessed from above, and the other from below as refrigerator cabinet 102 (shown in FIGS. 1 and 2) is assembled.

A substantially flat bottom panel engagement portion 220 extends from reinforcing section 216 and is substantially aligned with liner base portion 210. Engagement portion 220 facilitates press fit engagement and attachment of bottom panel 156 to bottom mullion 112 once bottom mullion 112 is attached to case 106 (shown in FIGS. 1 and 2).

While the illustrated shaped of bottom mullion 112 has been found particularly useful with certain constructions of refrigerator liners, front rails, and case bottom panels, it is anticipated that the shape of bottom mullion 112 could be modified in alternative embodiment to form channels 208, 218 for simple and direct hand insertion to a variety of refrigerator front rails and liners.

Figure 4:
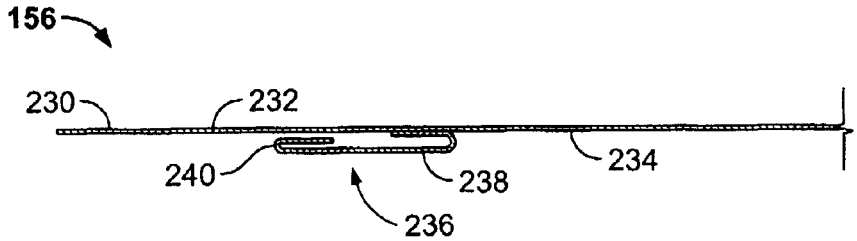
FIG. 4 is a partial cross sectional view of a casing bottom panel for the refrigerator shown in FIGS. 1 and 2.

FIG. 4 is a partial cross sectional view of casing bottom panel 156 including a forward end 230, an upper outer surface 232 and a lower outer surface 234 extending opposite one another. A fastening projection 236 extends from lower surface 234 and includes an extended support portion 238 depending from and extending substantially parallel to lower surface 234 but in a spaced apart relationship to panel lower surface 234. A rounded tongue 240 extends from a distal end of support portion 238 and is also positioned in a spaced apart relationship to panel lower surface 234. Tongue 240 is spaced from panel lower surface 234 so as to create an interference fit with bottom mullion engagement portion 220 (shown in FIG. 3). Support portion 238 is at least somewhat resilient in an exemplary embodiment such that fastening projection 236 is deflected when bottom mullion engagement portion 220 is received between tongue 240 and case bottom panel lower surface 234. Deflection of resilient support portion 238 produces a biasing force to hold tongue 140 to bottom mullion 112. As such, fastening projection 236 is essentially a clip attached to bottom panel 156 for simple hand insertion to bottom mullion engagement surface 220 (shown in FIG. 3) without tools and expensive fixtures for automated equipment. Thus, fastening projection 236 securely retains case bottom panel 156 to bottom mullion 112 (shown in FIGS. 1–3) with press fit engagement.

In one embodiment, fastening projection 236 is fabricated from galvanized steel and attached to case bottom panel 156 according to known techniques. It is contemplated, however, that fastening projection 236 could be fabricated from other suitable materials and furthermore may be integrally formed into bottom panel 156 as desired. It is further contemplated that other configurations and adaptations of fastening projection 236 may be employed to achieve the instant advantages of the present invention and without departing from the scope of the present claims.

Figure 5:
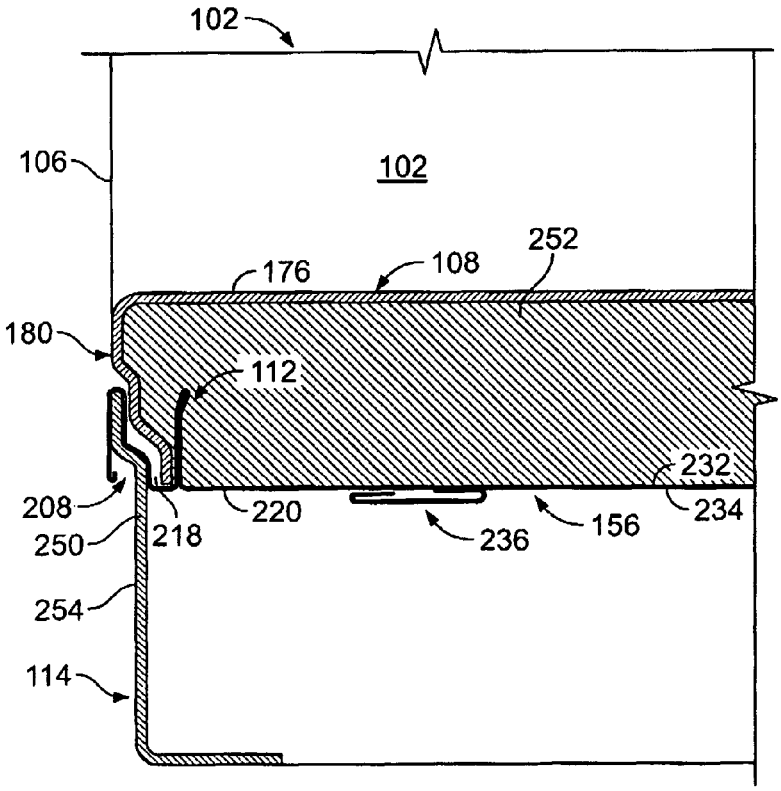
FIG. 5 is a schematic cross sectional view of a portion of the refrigerator shown in FIGS. 1 and 2.

FIG. 5 is a schematic cross sectional view of a portion of a complete refrigerator cabinet 102 and illustrates bottom mullion 112 interfacing with inner liner 108 and case bottom panel 156. A lower portion of liner flange 180 is contoured into a shape substantially complimentary to a forward portion (to the left in FIG. 5) of bottom mullion liner channel 218. Flange 180 is therefore received in bottom mullion 218 with a secure interference fit with simple press fit engagement after liner 108 has been installed into outer case 106. Bottom mullion engagement portion 220 is received in bottom panel fastening projection 236 in an overlapping arrangement with bottom pane) forward end 230, also with press-fit engagement, and refrigerator from rail 114 includes a contoured upper end 250 that is substantially complementary in shape to a rearward portion (to the right in FIG. 5) of bottom mullion rail channel 208 with secure press-fit engagement.

Liner bottom wall 176 extends substantially parallel to and in a spaced apart relationship from case bottom panel upper surface 232, and a foam insulation medium 252 is interposed between liner 108 and upper surface 232 of case bottom panel 156.

Fresh food compartment 102 extends above liner bottom floor 176 and is insulated by foam medium 252. Front rail 114 includes a grille (not shown) extending on a front face 254 thereof that allows airflow through the grille to ventilate the machinery compartment at the bottom rear end of cabinet 102 beneath case bottom panel 156.

Cabinet 102 (shown in FIG. 1) may be fabricated according to the following method. Inner liner 108 (shown in FIGS. 1, 2, and 5), including mullion 182 (shown in FIG. 2) is inserted into and secured to casing shell 150 (shown in FIG. 2) according to known methods and techniques. Mullion strip 110 (shown in FIG. 1) is secured to casing outer faces 164, 166 (shown in FIG. 2) over mullion 182.

Lower rail 114 (shown in FIGS. 1 and 5) is press fit to bottom mullion rail channel 208 (shown in FIGS. 3 and 5), assisted by bottom mullion guide portion 204 (shown in FIG. 3) such that lower rail 114 is securely received in rail channel 208 with an interference fit. Bottom mullion 112 (shown in FIGS. 1, 2, 3, and 5) is press-fit to inner liner 108, assisted by bottom mullion guide portion 204, such that inner liner flange 180 (shown in FIGS. 2 and 5) is securely received in bottom mullion liner channel 218 (shown in FIGS. 3 and 5) with an interference fit. The casing bottom panel 156 (shown in FIGS. 2, 4 and 5) is press fit to bottom mullion 112 such that retaining tongue 240 (shown in FIG. 4) engages bottom mullion engagement surface 220 (shown in FIGS. and 5). Casing rear panel 158 is attached to casing shell 150 and casing bottom panel 156, and foam insulating medium 252 (shown in FIG. 5) is injected between casing 106 (shown in FIGS. 1, 2 and 5) and the inner liner. The foam insulation is then cured to solidify cabinet 102.

Storage drawers 120 (shown in FIG. 1), storage shelves, compartment doors 132, 134, (shown in FIG. 1) airflow control mechanism 216 (shown in FIG. 1) and other noted components discussed in relation to FIG. 1 are then secured to cabinet 102 according to known methods and techniques. Refrigeration cycle components (not shown) are mounted in the cabinet machinery compartment and coupled to appropriate controls to complete assembly of refrigerator 90 (shown in FIG. 1).

Therefore, casing bottom panel 156 may be securely attached to casing 106 with a simple and straightforward clip arrangement that avoids additional tooling costs and fixtures for automated equipment to attach casing bottom panel 156 to case 106 after liner 108 has been installed into casing shell 150. Consequently, manufacturing and assembly costs of refrigerator 90 are reduced while using advantageous foaming techniques that reduce stress on liner 108 that may lead to undesirable cracking of the liner in use.

Moreover, and as best illustrated in FIG. 5, bottom mullion 112 substantially eliminates problematic foam leaks in conventional refrigerators in the vicinity of the front rail/liner interface. As is evident in FIG. 5, opposing bottom mullion channels 218, 208 that receive liner flange 180 and front rail 114, respectively, are separated from one another due to the configuration of bottom mullion 112. Moreover, contoured lower flange 180 of inner liner 108 forms a double barrier against foam leaks such that when liner flange 180 is tightly press-fit to bottom mullion liner channel 208, it is unlikely that any foam insulation medium 252 will flow past the interface between liner flange 180 bottom mullion third retainer portion 212 (shown in FIG. 5), the interface between liner flange 180 and bottom mullion liner base portion 210 (shown in FIG. 3) and the interface between liner flange 180 and bottom mullion first retaining portion 202 (shown in FIG. 3) to reach the exterior of bottom mullion 112 and liner 108. Foam leaks are therefore substantially eliminated.

While the invention has been described in terms of various specific embodiments, those skilled in the art will recognize that the invention can be practiced with modification within the spirit and scope of the claims.

The invention claimed is:

1. A refrigeration appliance cabinet comprising:

a bottom mullion, said bottom mullion comprising a pair of adjacent channels and an engagement portion proximate a first channel of said pair of adjacent channels, said first channel defined by a first retainer portion, a guide portion extending obliquely from said first retainer portion, a second retainer portion extending from said guide portion, a base portion extending substantially perpendicular to said second retainer portion, and a third retainer portion extending from said base portion in a direction substantially parallel to said first retainer portion, said first channel separating a second channel of said pair of adjacent channels from said engagement portion extending substantially perpendicular to said third retainer portion; and a casing in press fit engagement with said bottom mullion engagement portion.

2. A refrigeration appliance cabinet in accordance with claim 1 further comprising a bottom rail, said bottom rail received in said second channel of said bottom mullion.

3. A refrigeration appliance cabinet in accordance with claim 2, wherein said bottom rail comprises a contoured end portion received within said second channel and formed in a shape substantially complementary to a shape of said first retainer portion, said guide portion, and said second retainer portion of said bottom mullion.

4. A refrigeration appliance cabinet in accordance with claim 1 further comprising at least one inner liner and foam insulation between said inner liner and said casing.

5. A refrigeration appliance cabinet in accordance with claim 4, wherein said liner is received in said first channel of said bottom mullion.

6. A refrigeration appliance cabinet in accordance with claim 1, said casing further comprising a bottom panel, said bottom panel comprising a fastening projection, said engagement portion of said bottom mullion comprising an extended flat portion for press fit engagement with said fastening projection.

7. A refrigerator cabinet comprising:

a bottom mullion, said bottom mullion comprising a pair of adjacent channels and an engagement portion, a first channel of said pair of adjacent channels partially defined by a first retainer portion, a guide portion extending obliquely from said first retainer portion, a second retainer portion extending from said guide portion, a base portion extending substantially perpendicular to said second retainer portion, and a third retainer portion extending from said base portion in a direction substantially parallel to said first retainer portion, said first channel separating a second channel of said pair of adjacent channels from said engagement portion extending substantially perpendicular to said third retainer portion; and a casing in press fit engagement with said bottom mullion engagement portion.

8. A refrigerator cabinet in accordance with claim 7 wherein said bottom mullion engagement portion comprises an engagement surface, and said casing comprises a fastening projection engaging said engagement surface.

9. A refrigerator cabinet in accordance with claim 8 wherein said fastening projection comprises a tongue that is separated from said engagement surface.

10. A refrigerator cabinet comprising:

a casing;

an inner liner within said casing, said inner liner comprising at least one refrigeration compartment; and a bottom mullion, said bottom mullion comprising a pair of adjacent channels and an engagement portion, said bottom mullion configured to receive a portion of said inner liner, said casing configured to receive a portion of said bottom mullion with press fit engagement, a first channel of said pair of adjacent channels at least partially defined by a first retainer portion, a guide portion extending obliquely from said first retainer portion, a second retainer portion extending from said guide portion, a base portion extending substantially perpendicular to said second retainer portion, and a third retainer portion extending from said base portion in a direction substantially parallel to said first retainer portion, said first channel separating a second channel of said pair of adjacent channels from said engagement portion extending substantially perpendicular to said third retainer portion.

11. A refrigerator cabinet in accordance with claim 10 further comprising a lower rail, said bottom mullion configured to receive said lower rail.

12. A refrigerator in accordance with claim 11, wherein said bottom mullion comprises opposing side surfaces, one of said side surfaces comprising said second channel for receiving said lower rail, the other of said side surfaces comprising said first channel for receiving said inner liner.

13. A refrigerator cabinet in accordance with claim 11, wherein said lower rail comprises a contoured end portion received within said second channel and formed in a shape substantially complementary to a shape of said first retainer portion, said guide portion, and said second retainer portion of said bottom mullion.

14. A refrigerator cabinet in accordance with claim 10, wherein said casing further comprises a clip, and a tongue extending from said clip.

* * * * *